US011453102B2

(12) United States Patent
Su

(10) Patent No.: US 11,453,102 B2
(45) Date of Patent: Sep. 27, 2022

(54) CLENCH WRENCH

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 797 days.

(21) Appl. No.: 16/378,796

(22) Filed: Apr. 9, 2019

(65) Prior Publication Data

US 2019/0232467 A1 Aug. 1, 2019

Related U.S. Application Data

(63) Continuation-in-part of application No. 15/990,979, filed on May 29, 2018, now Pat. No. 10,792,791, which is a continuation-in-part of application No. 15/387,824, filed on Dec. 22, 2016, now Pat. No. 10,286,526, which is a continuation-in-part of application No. 14/994,220, filed on Jan. 13, 2016, now Pat. No. 9,849,569.

(30) Foreign Application Priority Data

Mar. 18, 2015 (TW) ..... 104108634

(51) Int. Cl.
*B25B 13/06* (2006.01)
*B25B 13/46* (2006.01)
*B25B 23/00* (2006.01)

(52) U.S. Cl.
CPC ..... *B25B 13/06* (2013.01); *B25B 13/463* (2013.01); *B25B 23/0057* (2013.01); *B25B 23/0071* (2013.01)

(58) Field of Classification Search
CPC ... B25B 13/06; B25B 13/463; B25B 23/0057; B25B 23/0071; B25B 23/10; B25B 23/105
USPC ..... 81/60
See application file for complete search history.

(56) References Cited

U.S. PATENT DOCUMENTS 145,399 A 12/1873 Colbert
221,299 A 11/1879 Gray
625,149 A 5/1899 Crocker
(Continued)

FOREIGN PATENT DOCUMENTS

CN 203566583 U 4/2014
CN 205497299 U 8/2016
(Continued)

*Primary Examiner* — Joseph J Hail
*Assistant Examiner* — J Stephen Taylor
(74) *Attorney, Agent, or Firm* — Alan D. Kamrath; Karin L. Williams; Mayer & Williams PC

(57) ABSTRACT

A clench wrench has a structure including a handle and an engaging head. The engaging head defines an engaging space. A clenching device is mounted on the engaging head. The clenching device includes a resilient clenching member fixed to the engaging head and having a free end. The clenching member has a clenching portion at the free end. The free end of the clenching member is bendable to selectively clench an object. A block is disposed on the engaging head and abuts against the clenching member and counteracts a force that causes the clenching portion to move from the first position to the second position.

11 Claims, 19 Drawing Sheets

(56) References Cited

U.S. PATENT DOCUMENTS

| | | | | |
|---|---|---|---|---|
| 1,635,102 | A | 7/1927 | Watson | |
| 2,414,967 | A * | 1/1947 | Meyers | A63C 1/02 280/11.18 |
| 2,751,802 | A | 6/1956 | Reuillard | |
| 2,757,564 | A | 8/1956 | Reaves | |
| 4,993,725 | A | 2/1991 | Barnes | |
| 6,481,315 | B1 | 11/2002 | Chang et al. | |
| 6,752,046 | B1 | 6/2004 | Lee | |
| 6,871,570 | B1 * | 3/2005 | Santillan | B25B 13/461 81/125 |
| 6,889,581 | B2 | 5/2005 | Chen | |
| 6,948,406 | B1 * | 9/2005 | Li | B25B 23/0035 81/60 |
| 7,188,552 | B1 * | 3/2007 | Koppenhoefer | B25B 13/06 81/125 |
| 8,261,635 | B2 | 9/2012 | Lee et al. | |
| 8,535,323 | B2 | 9/2013 | Keefer et al. | |
| 9,205,538 | B2 * | 12/2015 | Yang | B25B 13/461 |
| 9,308,631 | B2 | 4/2016 | Shyu | |
| 9,393,676 | B2 | 7/2016 | Weber | |
| 9,592,594 | B2 | 3/2017 | Chen | |
| 9,789,593 | B2 | 10/2017 | Kao | |
| 9,849,569 | B2 | 12/2017 | Su | |
| 2017/0100820 | A1 * | 4/2017 | Su | B25B 13/463 |

FOREIGN PATENT DOCUMENTS

| | | | |
|---|---|---|---|
| DE | 887779 | B | 6/1954 |
| JP | H06226649 | A | 8/1994 |
| TW | 483359 | U | 4/2002 |
| TW | 547258 | U | 8/2003 |
| TW | 551251 | U | 9/2003 |
| TW | 201330987 | A | 8/2013 |
| TW | M537002 | U | 2/2014 |
| TW | M476030 | U | 4/2014 |
| TW | M492226 | U | 12/2014 |
| TW | M494064 | U | 1/2015 |
| TW | M498090 | U | 4/2015 |
| TW | I637820 | B | 10/2018 |

* cited by examiner

CLENCH WRENCH

CROSS REFERENCE TO RELATED APPLICATION

The present application is a continuation-in-part application of U.S. patent application Ser. No. 15/990,979 filed on May 29, 2018.

BACKGROUND OF THE INVENTION

1. Field of the Invention

The present invention relates to a wrench and, particularly, to a clench wrench.

2. Description of the Related Art

TW Pat. No. M476030 teaches a ratcheting box wrench. The wrench includes a ratchet wheel and an engaging hole. The engaging hole is adapted to receive a socket or an object to be wrenched. The engaging hole is defined by an inner periphery of the ratchet wheel. The socket is prevented from disengaging from the wrench by a resilient C-clip. The C-clip can prevent the object to be wrenched from disengaging from the wrench. In order to receive the C-clip, a groove is defined on an outer periphery of the ratchet wheel, and a plurality of openings extends through the inner and outer peripheries of the ratchet wheel. Thus, the C-clip is partially disposed in the hole and can abut an outer periphery of the socket.

The ratchet wheel has a complex design and has a high cost of manufacture. Furthermore, the C-clip can disengage from the ratchet wheel inadvertently when forcing the object to be wrenched to disengage from the hole, and it is difficult to reengage the C-clip with the ratchet wheel. Additionally, when the socket or the object is too slippery to grasp, a user often encounters difficulty to overcome C-clip's restraining force to disengage the socket or the object from the hole if the socket or object is too slippery to grasp.

TW Pat. No. 1637820 shows a wrench including a stop device. The wrench includes a body and a stop member. The body includes a driving head. The driving head defines a driving hole. The stop member is connected to the body. The stop member has a connecting portion, a stopping portion, and an elastic portion located between the connecting portion and the stopping portion. The connecting portion is fixedly connected to the driving head. The elastic portion has a first curved section and a second curved section. The curved direction of the first curved section is different from that of the second curved section. The stopping portion is movable relative to the body between the first position and the second position. The stopping portion is maintained in the first position when no force is applied thereto. When the stopping portion is in the first position, it can prevent the work piece from disengagement therefrom. When the stopping portion is in the second position, it is separated from the work piece.

The stop member is fixed to the back surface of the driving head through a locking member. When the stopping portion is moved to the second position, the locking member is subjected to torsion. Since the locking member is only a small pin member, the torsion can cause the locking member to fail to fixedly engage with the stop member, and the stop member, thus, cannot perform its original function after being rotated relative to the driving head.

The present invention is, therefore, intended to obviate or at least alleviate the problems encountered in the prior art.

SUMMARY OF THE INVENTION

According to the present invention, a clench wrench includes a structure including a first body defining a handle for a user to grasp and a second body defining an engaging head for engaging with an object to be clenched respectively. The engaging head defines an engaging space for receiving the object engaged with and to be driven by the clench wrench. The engaging head has two opposite sides with one side defining a front side and the other side defining a back side respectively and includes the engaging space extending through the front and back sides and defining an opening in each of the front and back sides.

A clenching device configured for clenching the object is mounted on the engaging head. The clenching device includes a resilient clenching member having a fixed end fixed to the engaging head and a free end. The clenching member has a clenching portion at the free end. The free end of the clenching member is bendable such that the clenching portion is operably movable in a first mode located at a first position and capable of clenching the object received by the engaging space, and a second mode disposed away from the engaging space and located at a second position and capable of letting the object engaged in the engaging space of the engaging head disengage therefrom.

A block is disposed on the engaging head and abuts against the clenching member and counteracts a force that causes the clenching portion to move from the first position to the second position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a clench wrench capable of preventing disengagement of an object engaged therewith from the clench wrench.

It is another objective of the present invention that the clench wrench selectively engages and disengages the object effortlessly.

Other objectives, advantages, and new features of the present invention will become apparent from the following detailed description of the invention when considered in conjunction with the accompanied drawings.

DETAILED DESCRIPTION OF THE INVENTION

Figure 1:
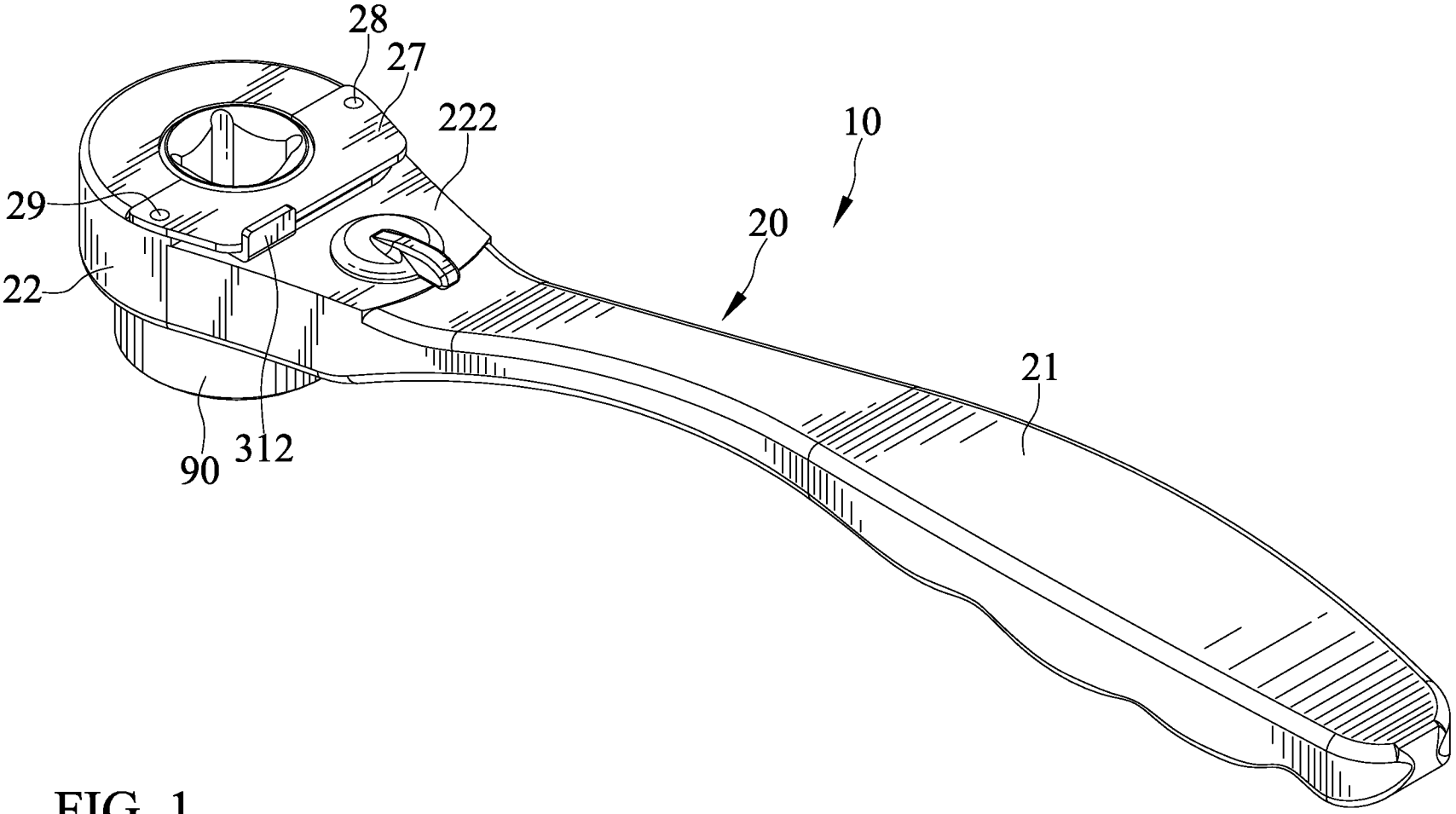
FIG. 1 is a perspective view of a clench wrench in accordance with a first embodiment of the present invention.
Figure 2:
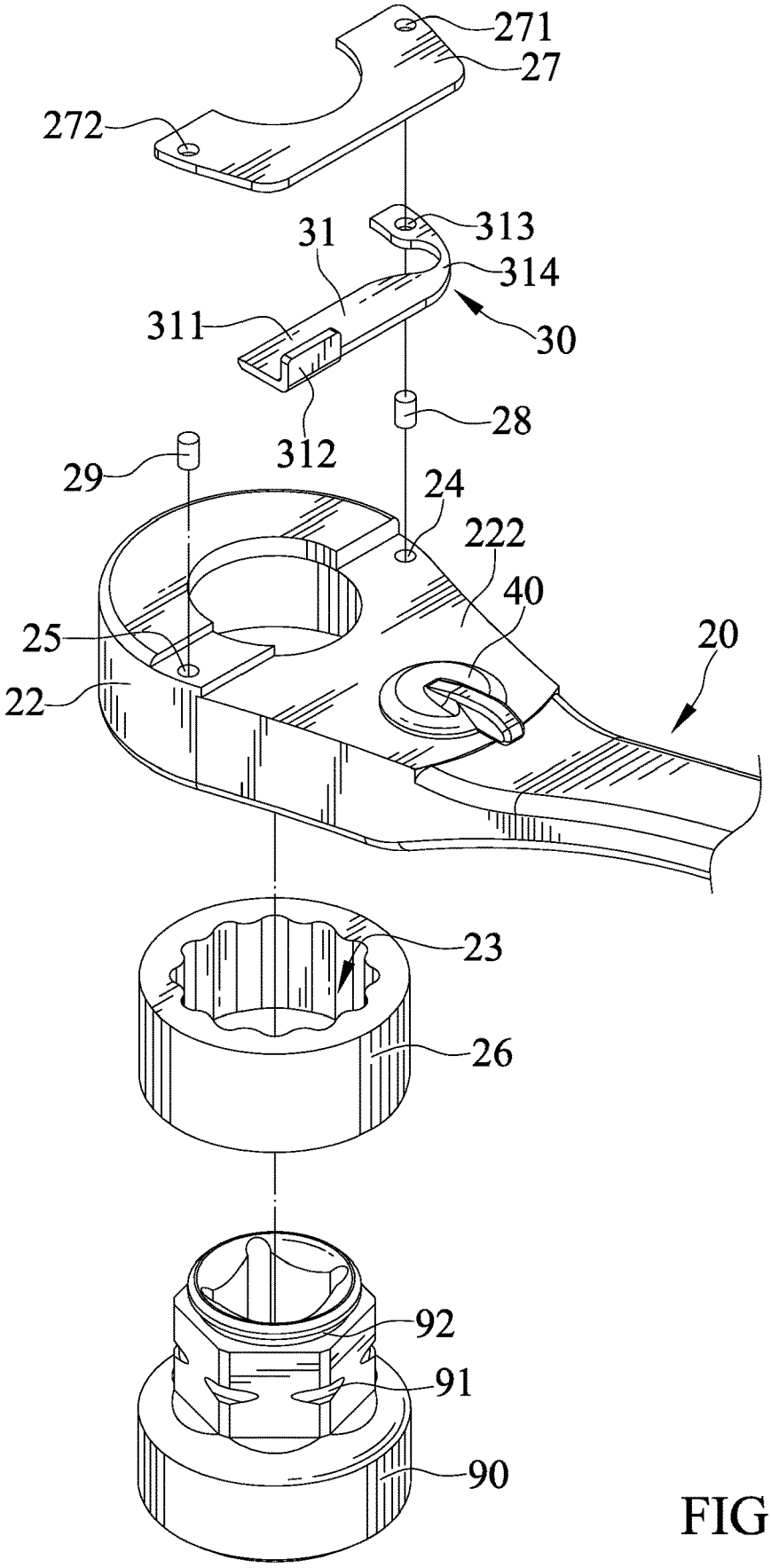
FIG. 2 is an exploded perspective view of the clench wrench of FIG. 1.

FIGS. 1 through 6 show a clench wrench 10 in accordance with a first embodiment of the present invention capable of preventing disengagement of an object engaged therewith from the clench wrench 10.

The clench wrench 10 has a structure 20 including a first body 21 and a second body 22. The first body 21 defines a handle for a user to grasp when operating the clench wrench 10. The second body 22 defines an engaging head for engaging with an object to be clenched. The second body 22 is integrated with the first body 21. In the embodiment, the first and second bodies 21 and 22 are defined from the one-piece structure 20, but is not limited thereto. Alternatively, the first and second bodies 21 and 22 can be two separate elements and are integrated together.

The engaging head has two opposite sides with one side defining a front side 221 and the other side defining a back side 222 respectively. The distance between the front and back sides 221 and 222 defines the thickness of the engaging head. The engaging head defines an engaging space 23 for receiving the object to be driven by the clench wrench 10. The engaging space 23 extends through the front and back sides 221 and 222 and defines an opening in each of the front and back sides 221 and 222. The engaging space 23 is defined by an inner periphery of a ratchet wheel 26. The ratchet wheel 26 is rotatably engaged with the engaging head and has a center of rotation about an axis L. The axis L extends in the thickness direction of the engaging head. The inner periphery of the ratchet wheel 26 is polygonal and includes ridges formed by peripheral sides. The ridges can facilitate turning of the object by the clench wrench 10.

Figure 3:
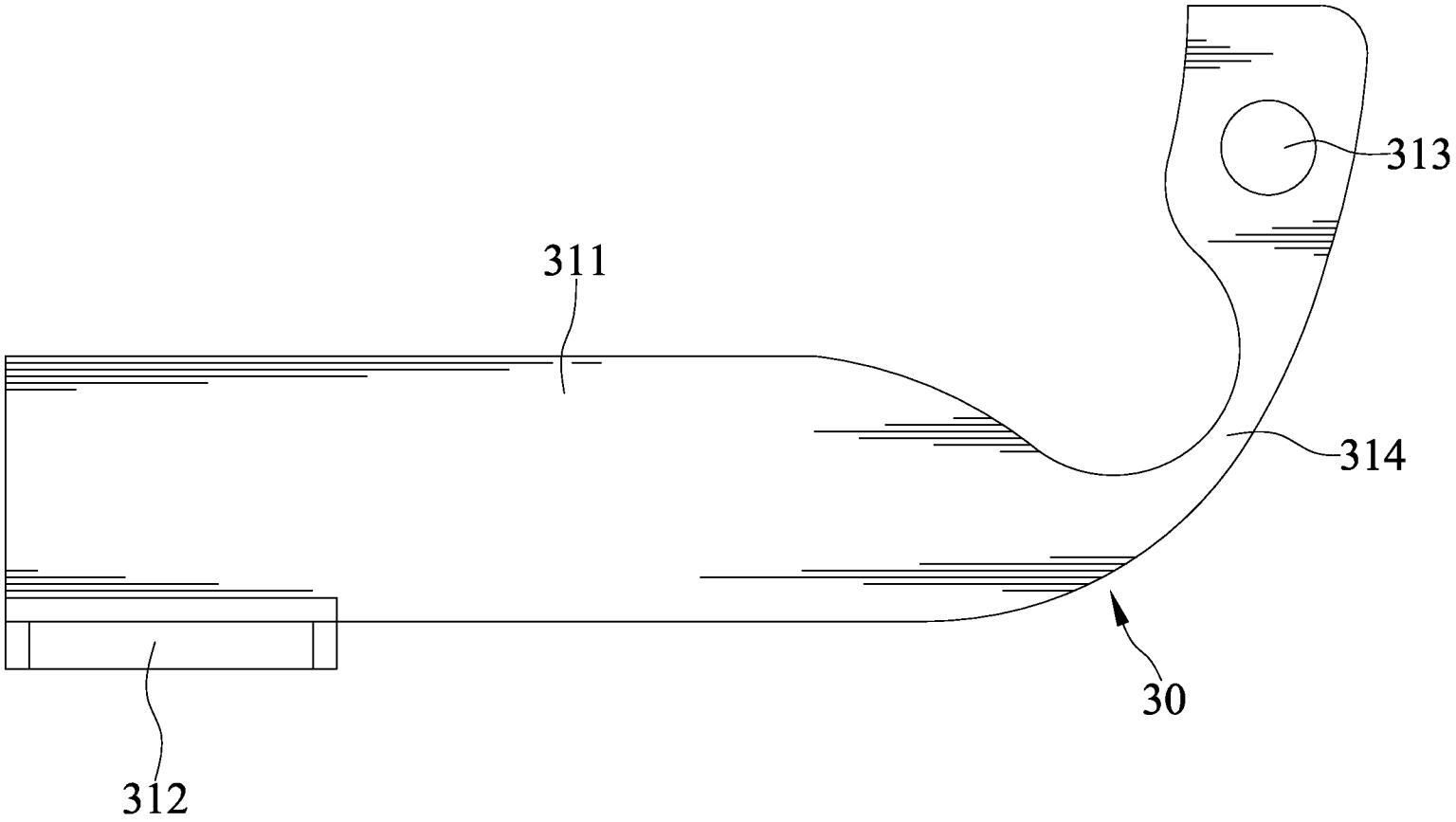
FIG. 3 is a side view of a clenching member of the clench wrench of FIG. 1.
Figure 4:
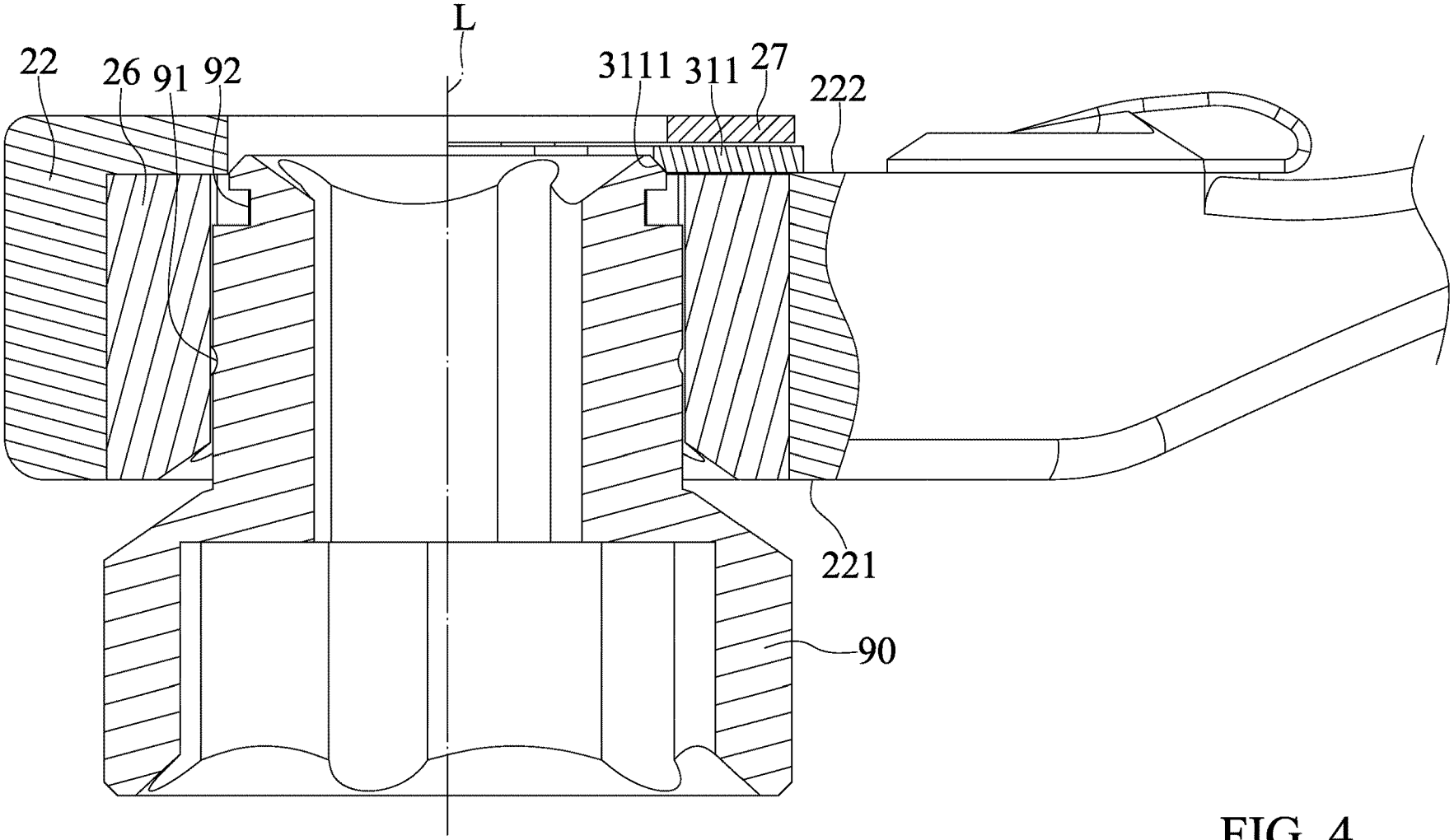
FIG. 4 is a cross-sectional view showing a socket inserted into an engaging space of the clench wrench of FIG. 1.
Figure 5:
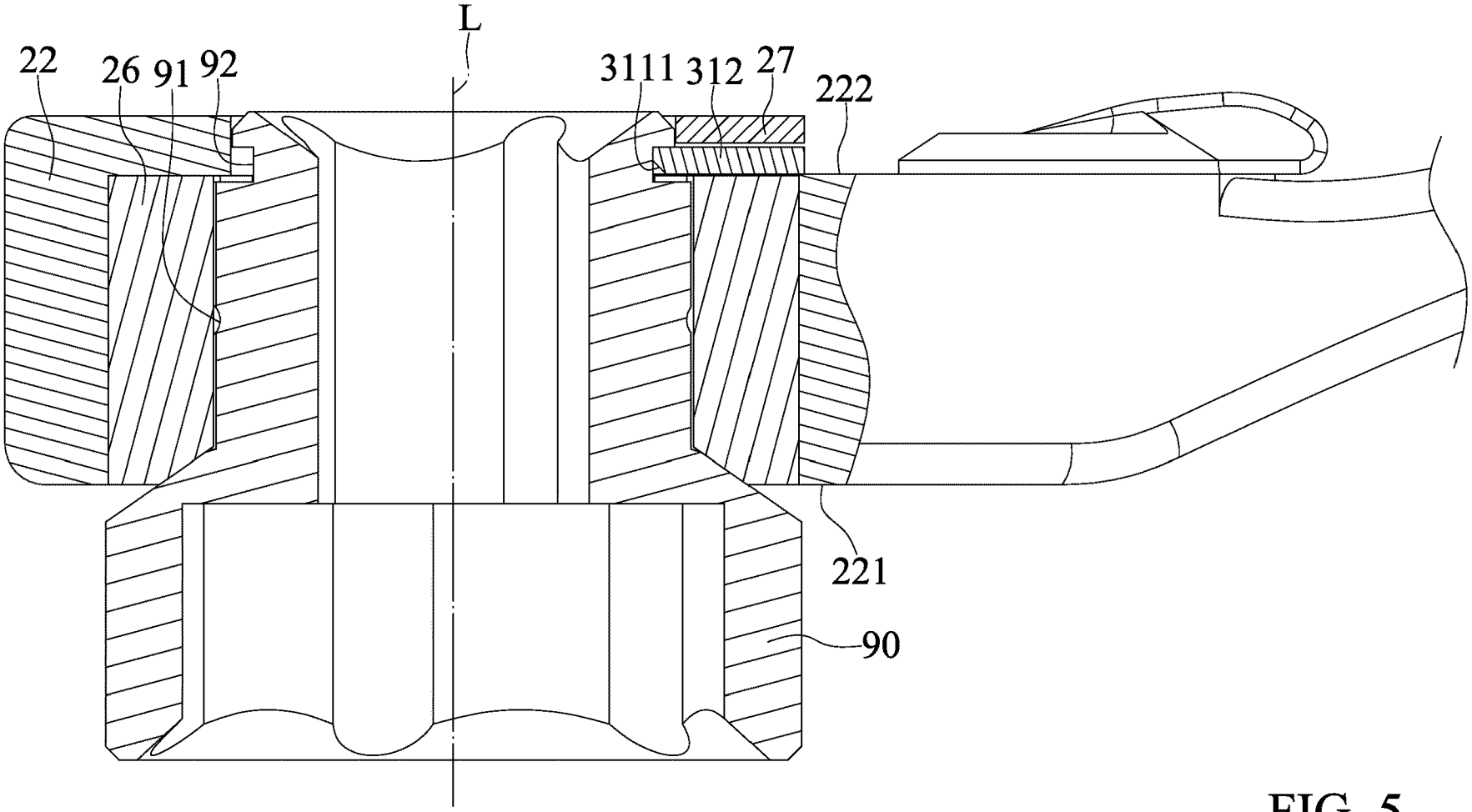
FIG. 5 is a cross-sectional view showing the clench wrench of FIG. 1 clenching and preventing the socket from disengaging therefrom.
Figure 6:
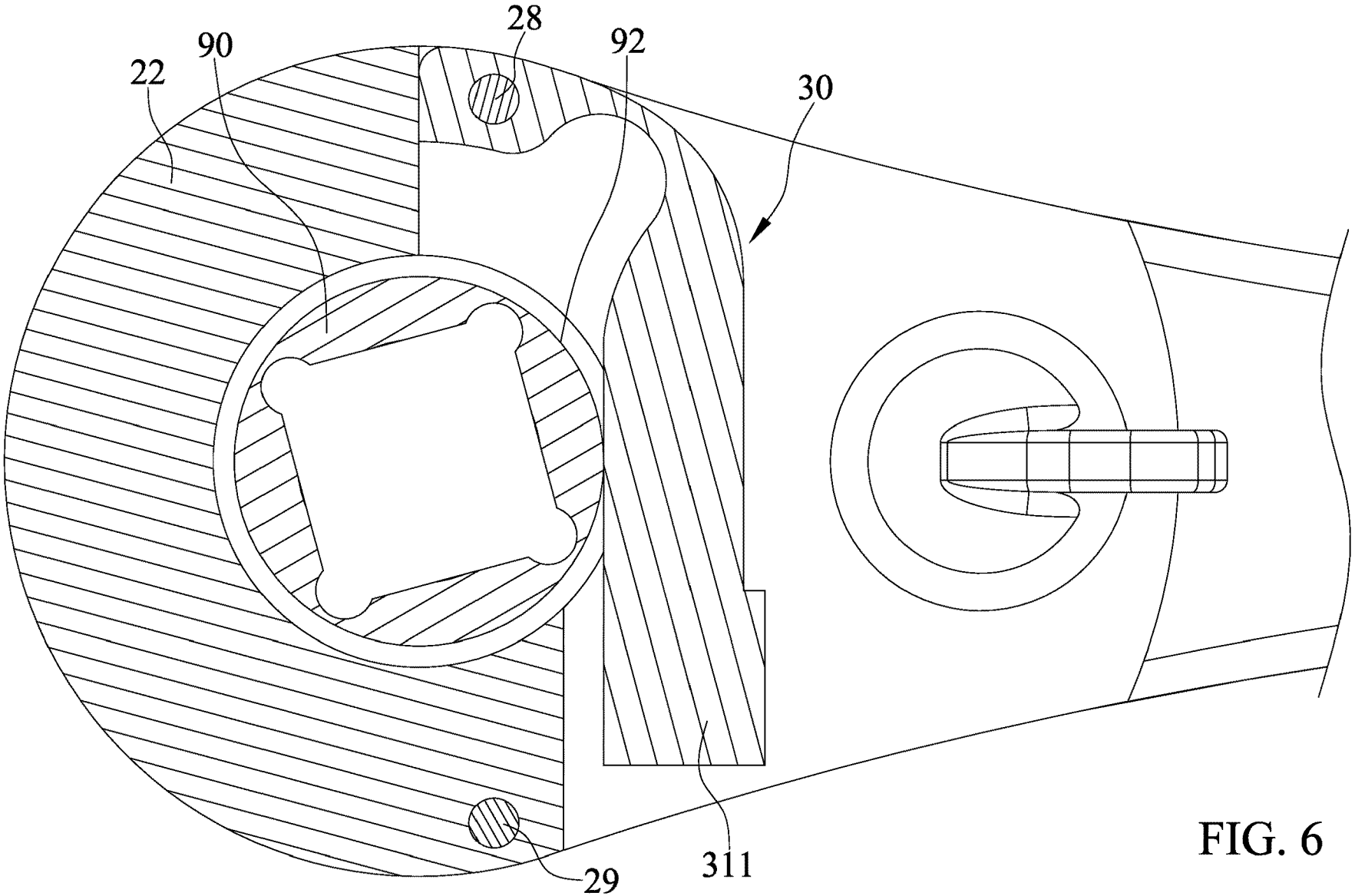
FIG. 6 is another cross-sectional view showing the clench wrench of FIG. 1 clenching the socket.
Figure 7:
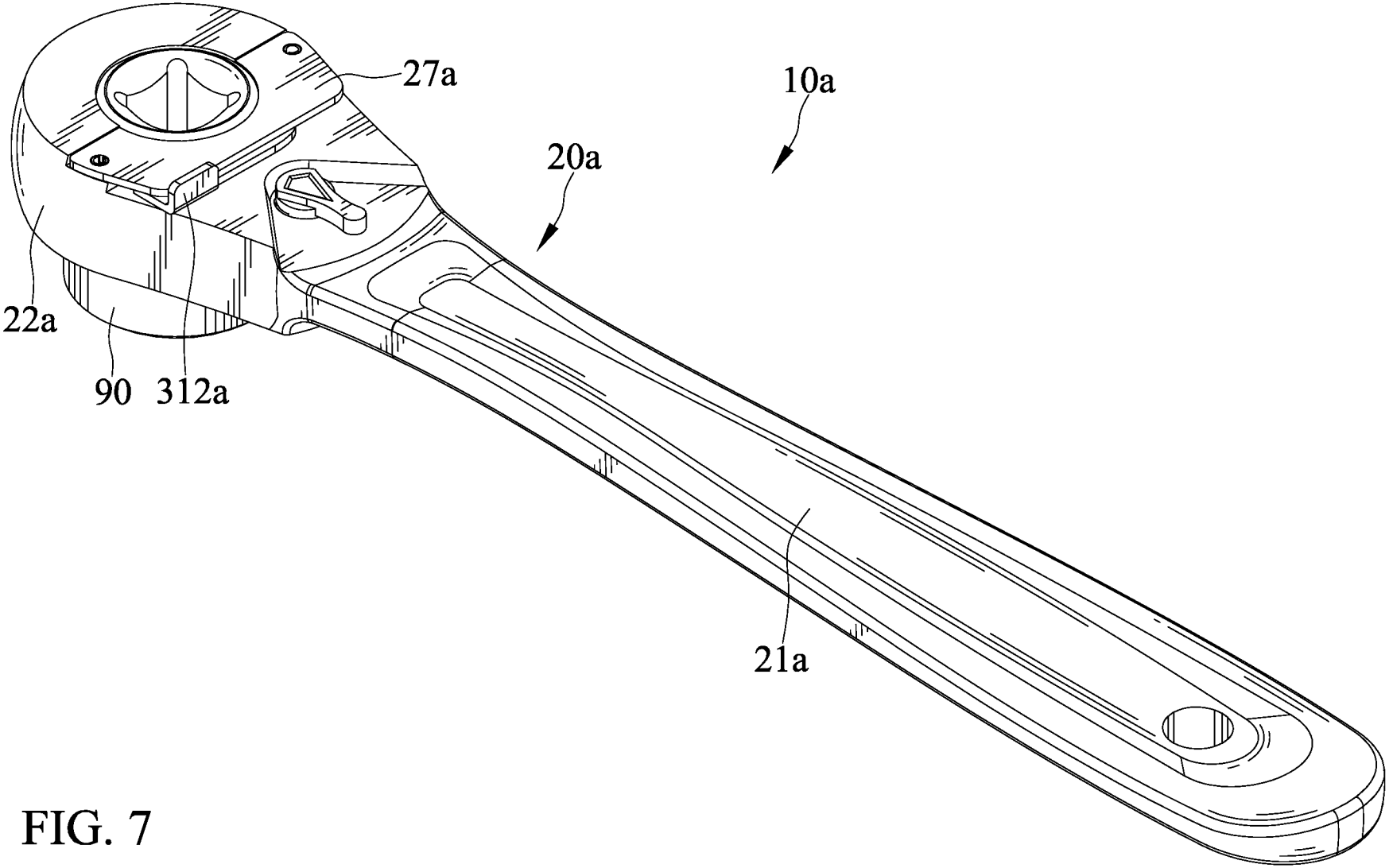
FIG. 7 is a perspective view of a clench wrench in accordance with a second embodiment of the present invention.
Figure 8:
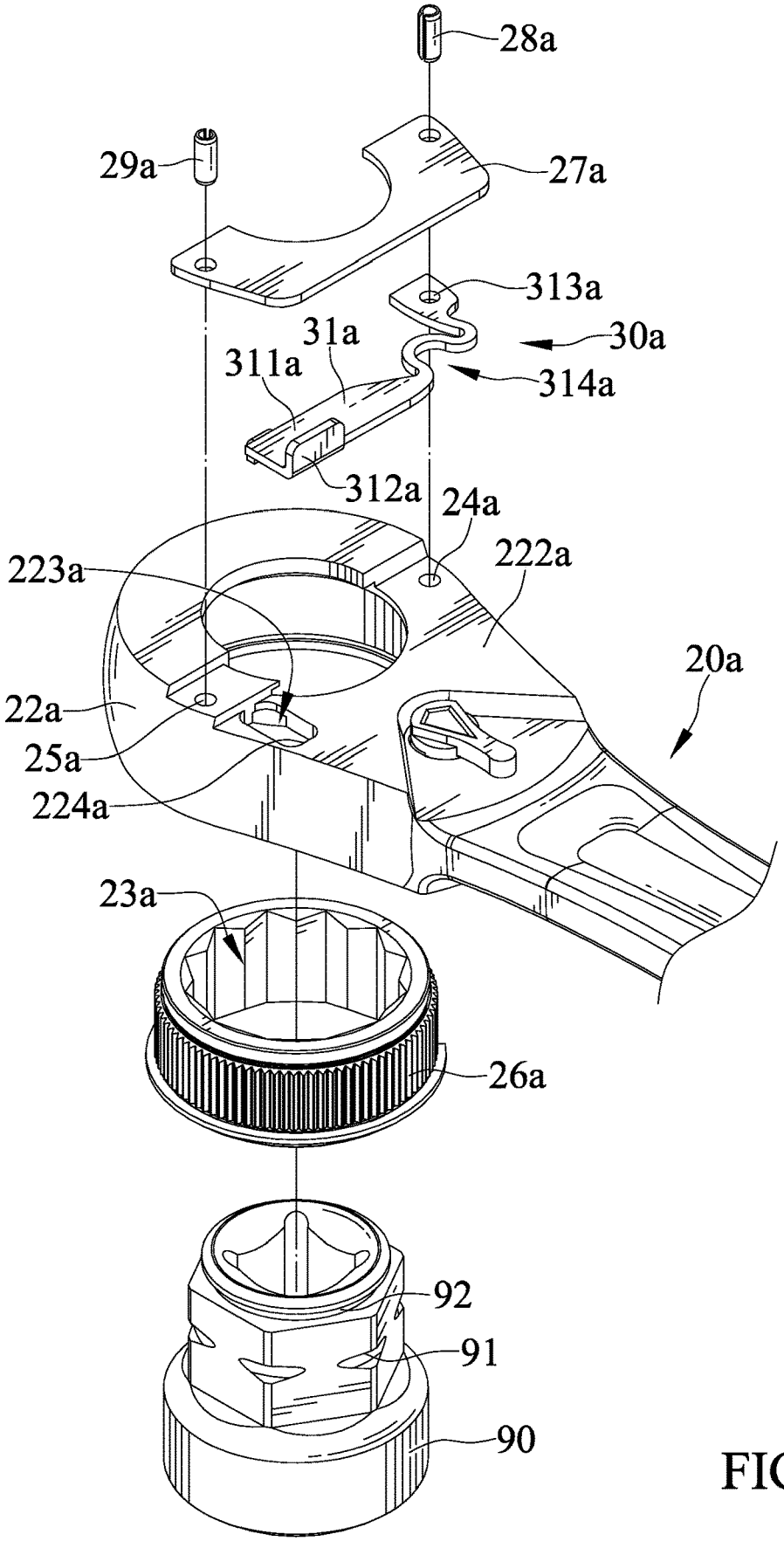
FIG. 8 is an exploded perspective view of the clench wrench of FIG. 7.
Figure 9:
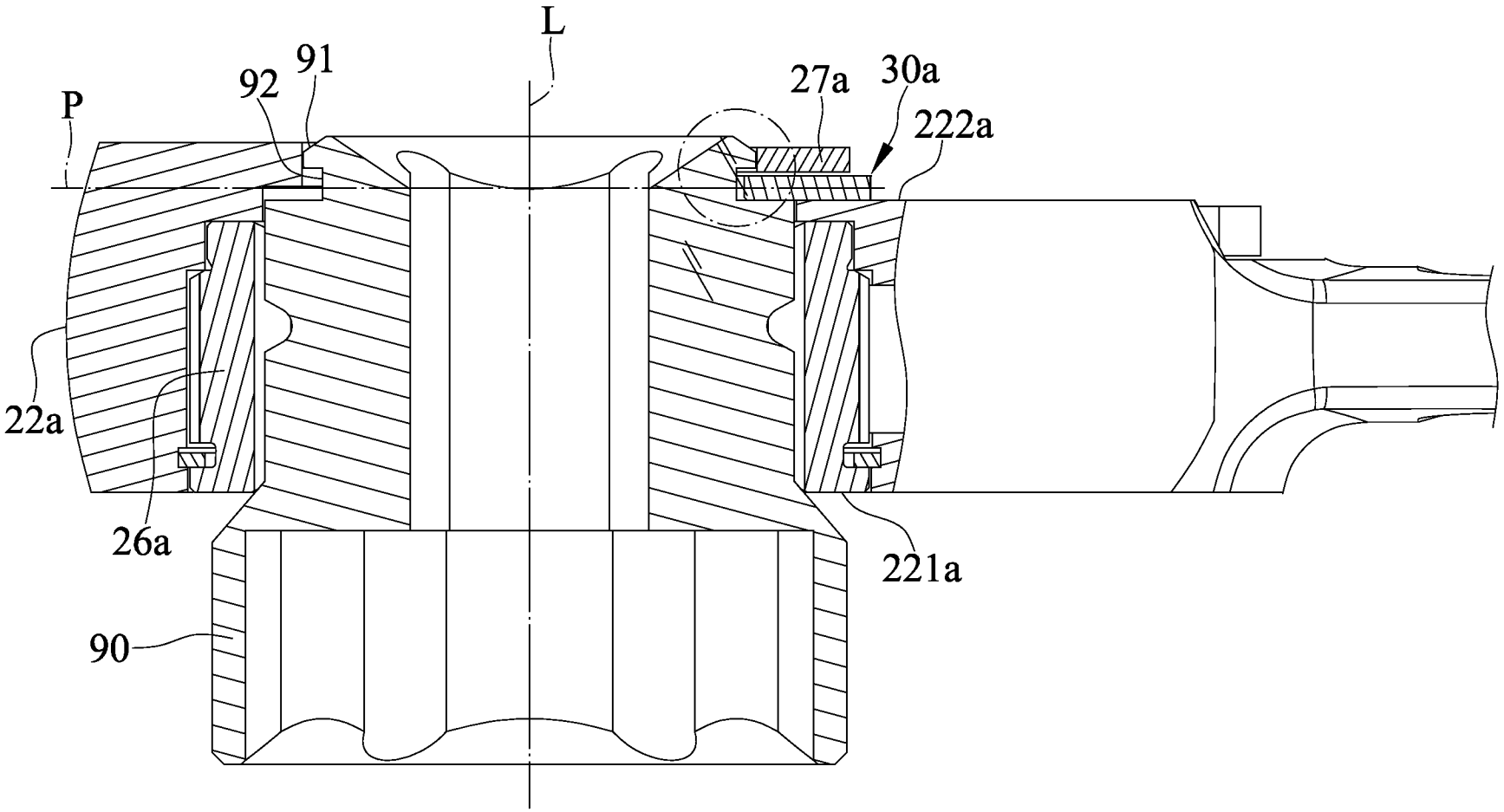
FIG. 9 is a cross-sectional view showing the clench wrench of FIG. 7 clenching and preventing the socket from disengaging therefrom.
Figure 10:
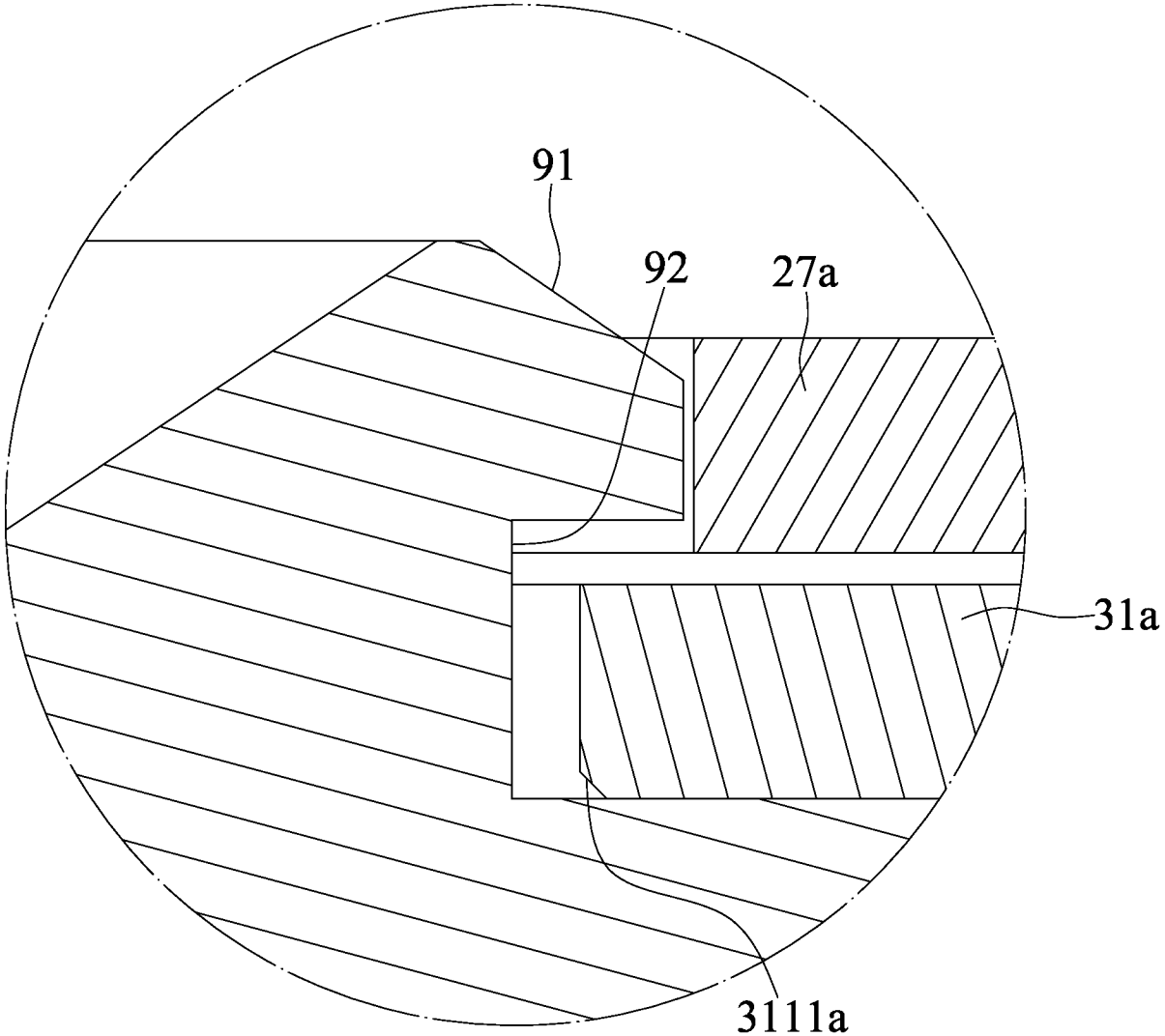
FIG. 10 is an enlarged view of a circled portion of FIG. 9.
Figure 11:
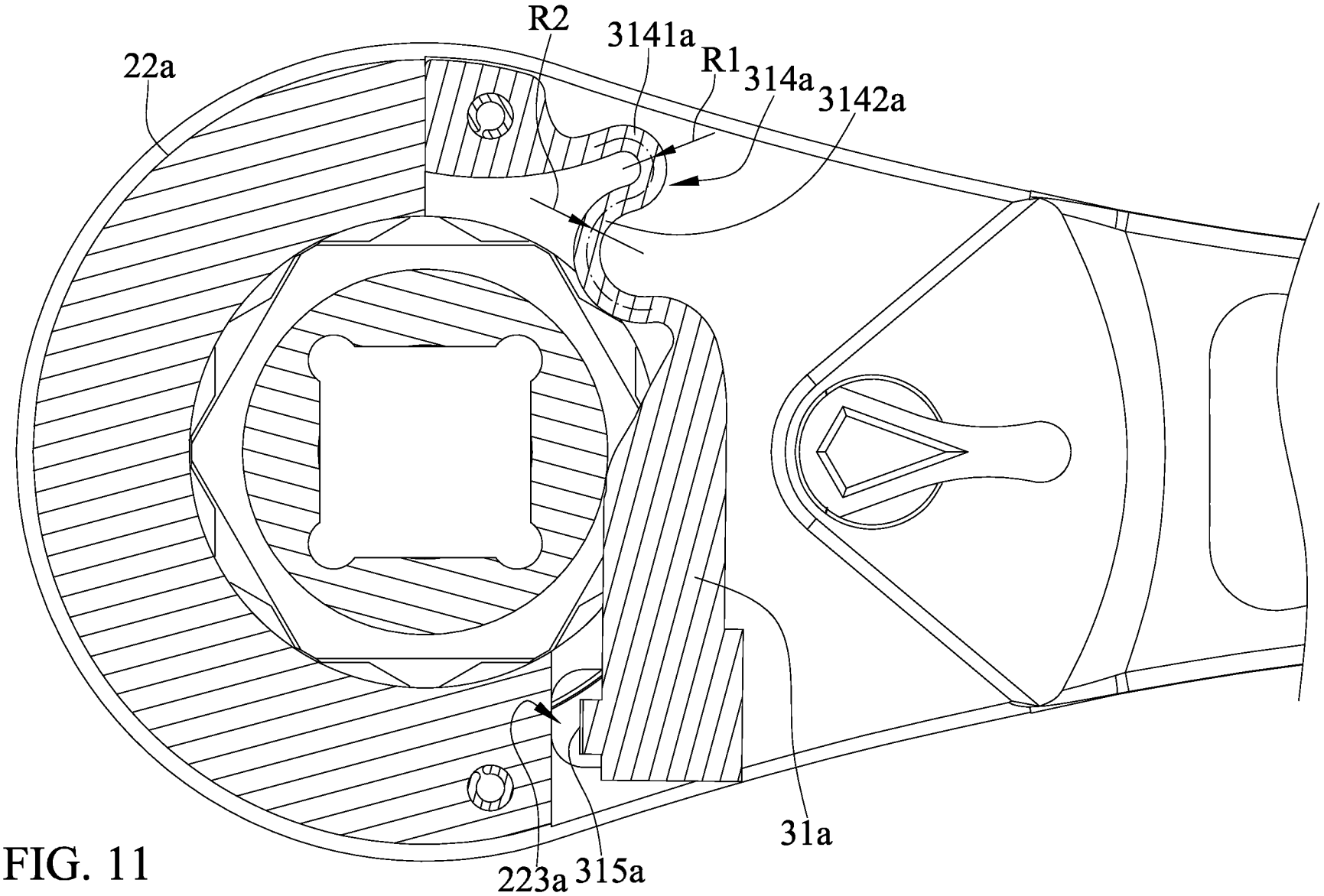
FIG. 11 is another cross-sectional view showing the clench wrench of FIG. 9 clenching the socket.
Figure 12:
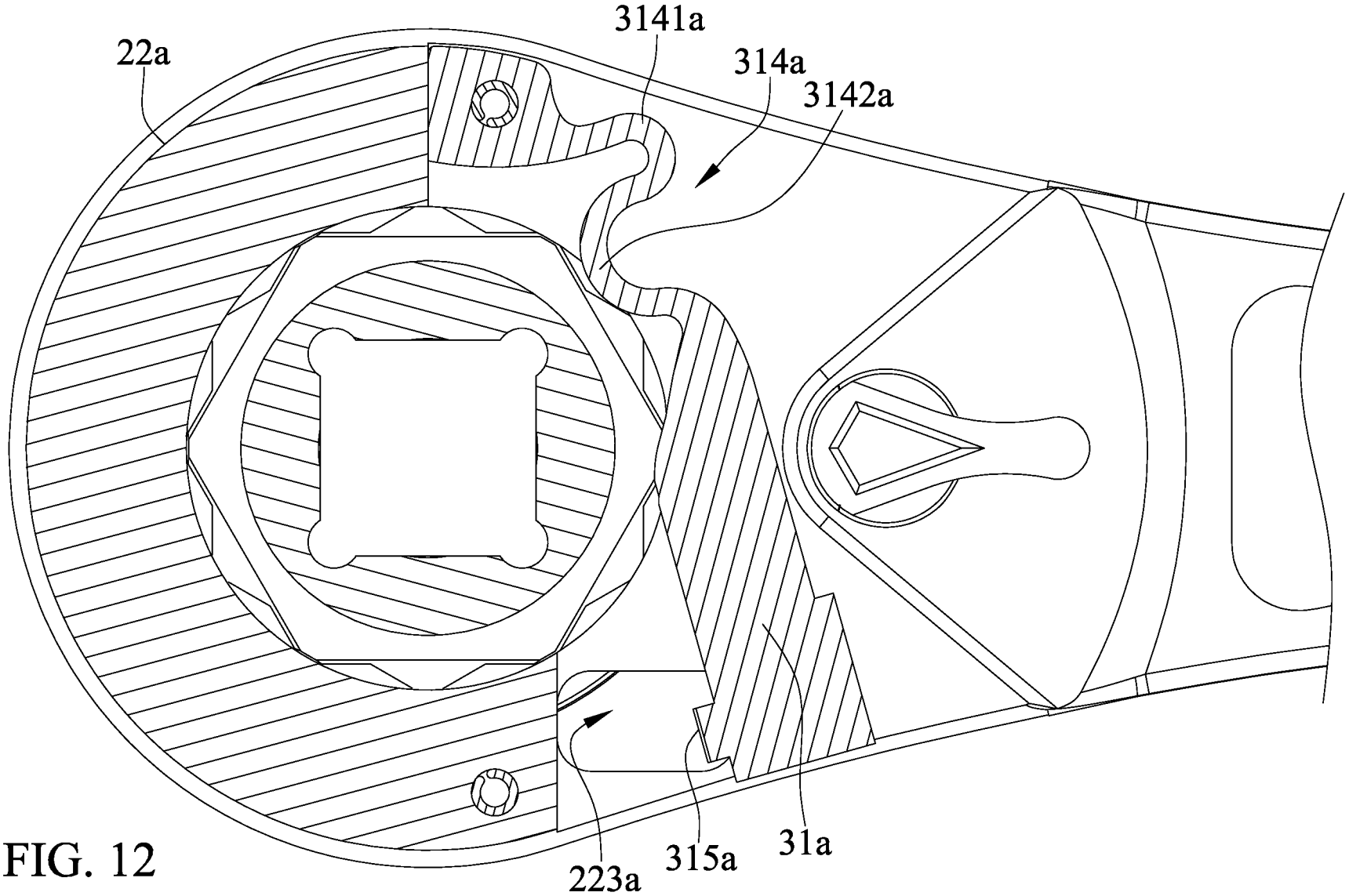
FIG. 12 is a cross-sectional view showing the clench wrench of FIG. 9 not clenching the socket.
Figure 13:
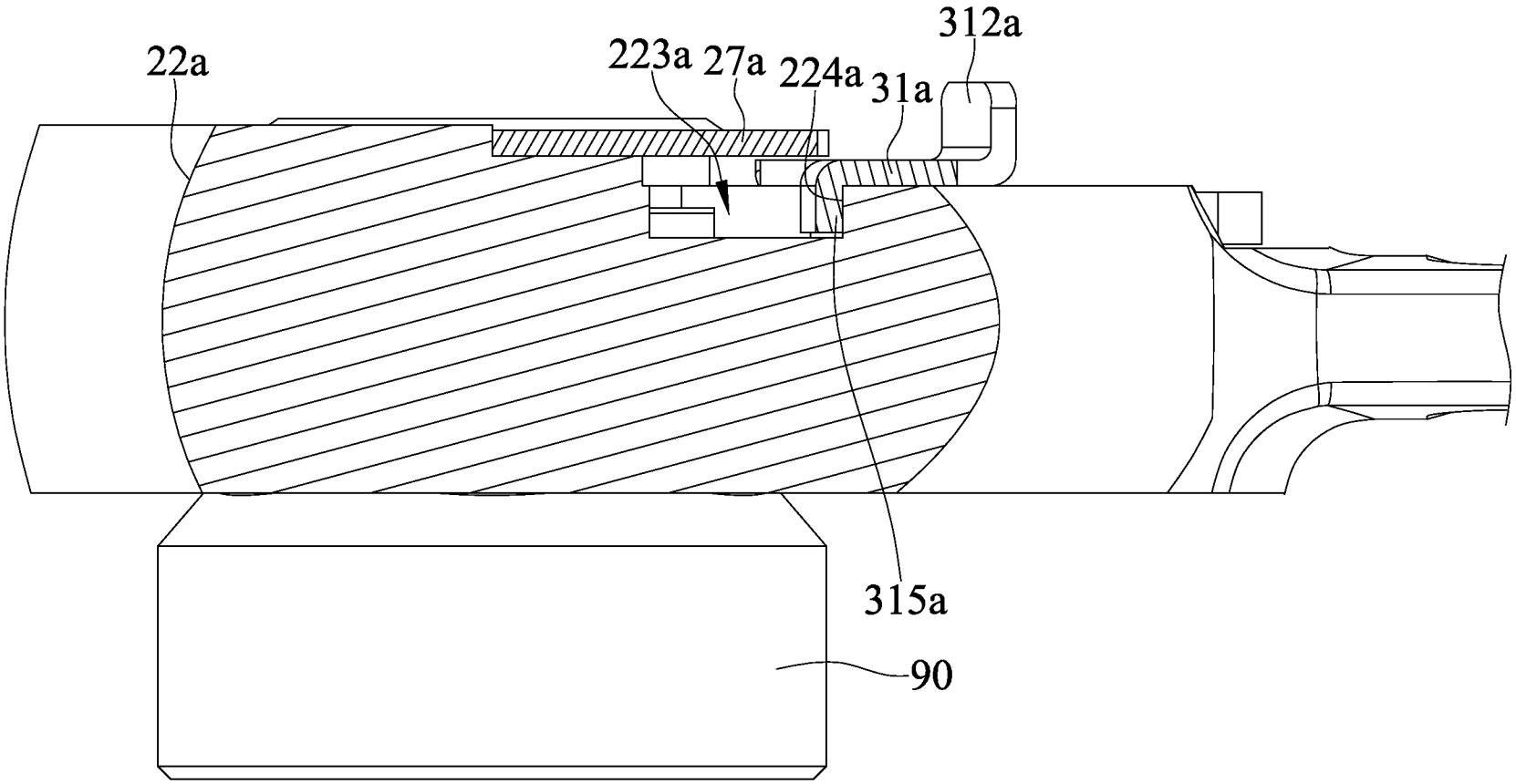
FIG. 13 is another cross-sectional view showing the clench wrench of FIG. 9 not clenching the socket.
Figure 14:
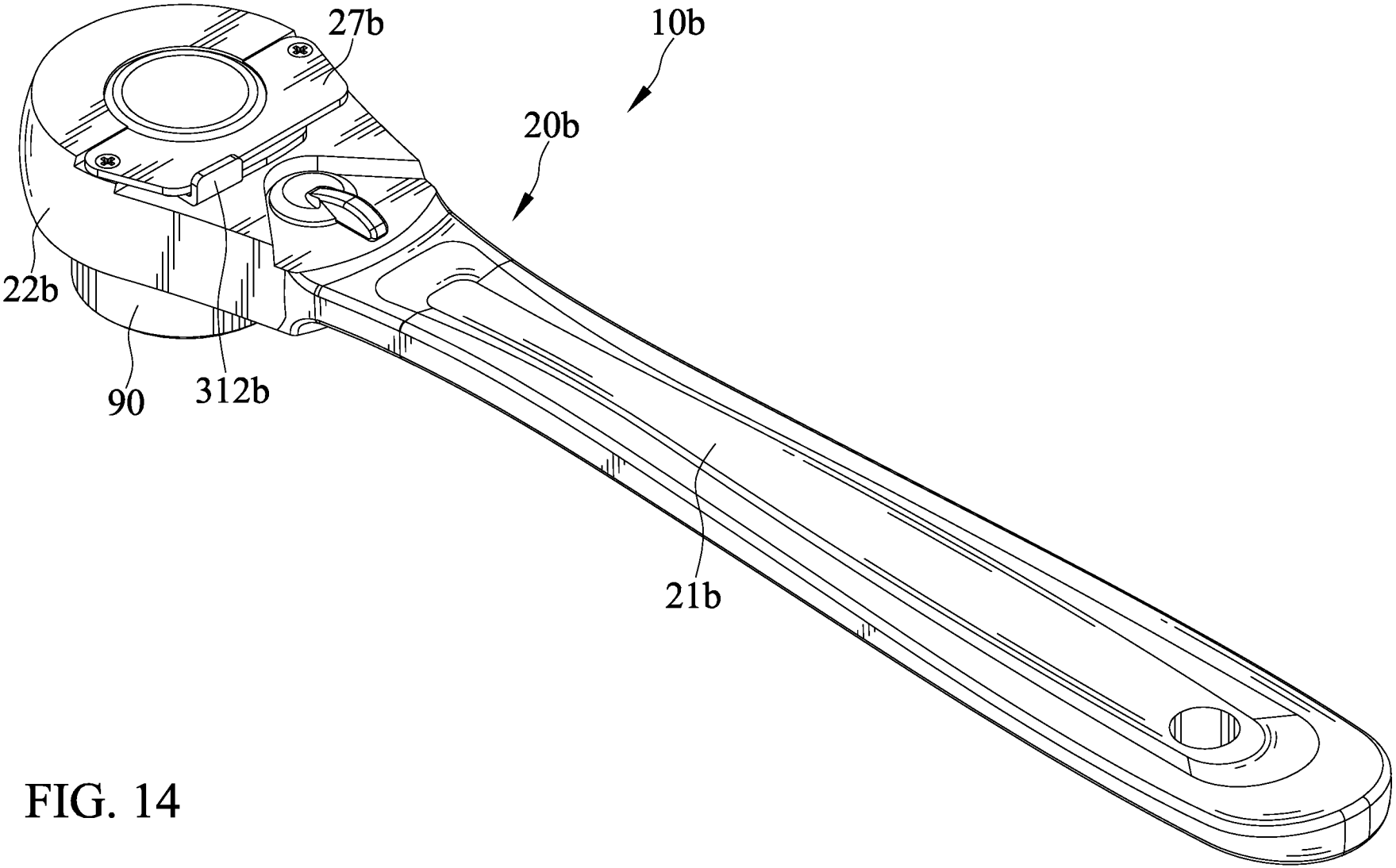
FIG. 14 is a perspective view of a clench wrench in accordance with a third embodiment of the present invention.
Figure 15:
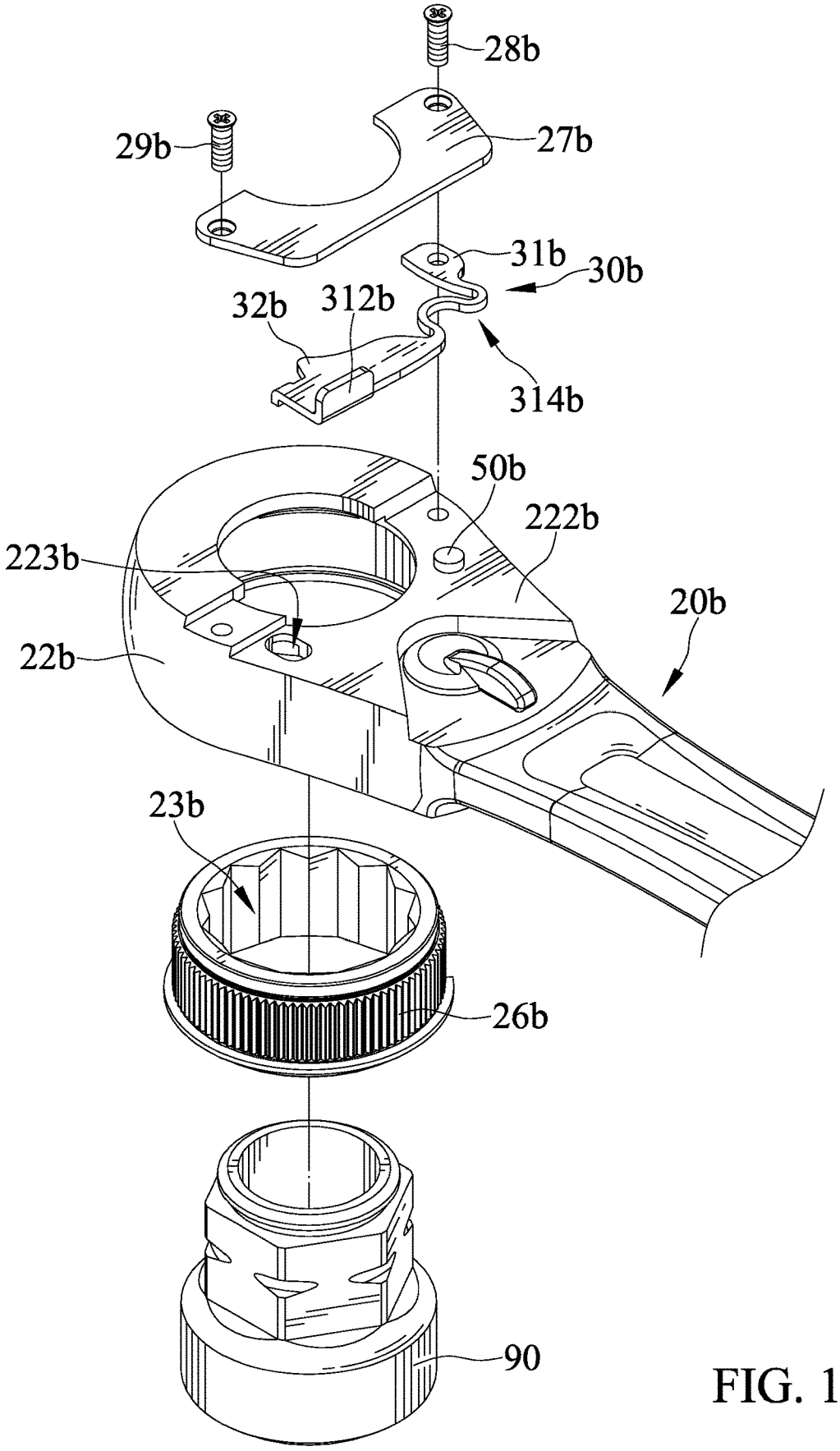
FIG. 15 is an exploded perspective view of the clench wrench of FIG. 14.
Figure 16:
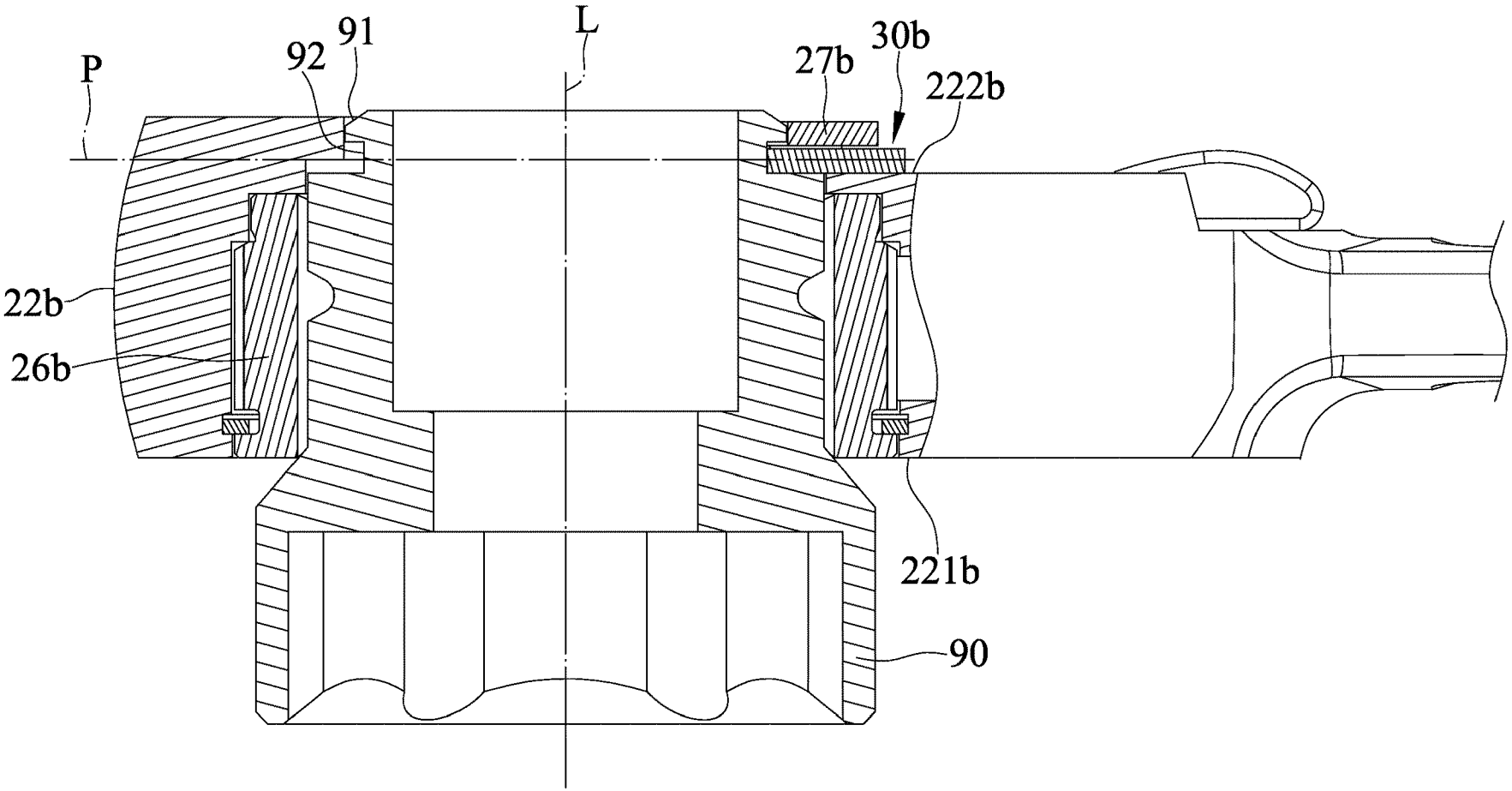
FIG. 16 is a cross-sectional view showing the clench wrench of FIG. 14 clenching and preventing the socket from disengaging therefrom.
Figure 17:
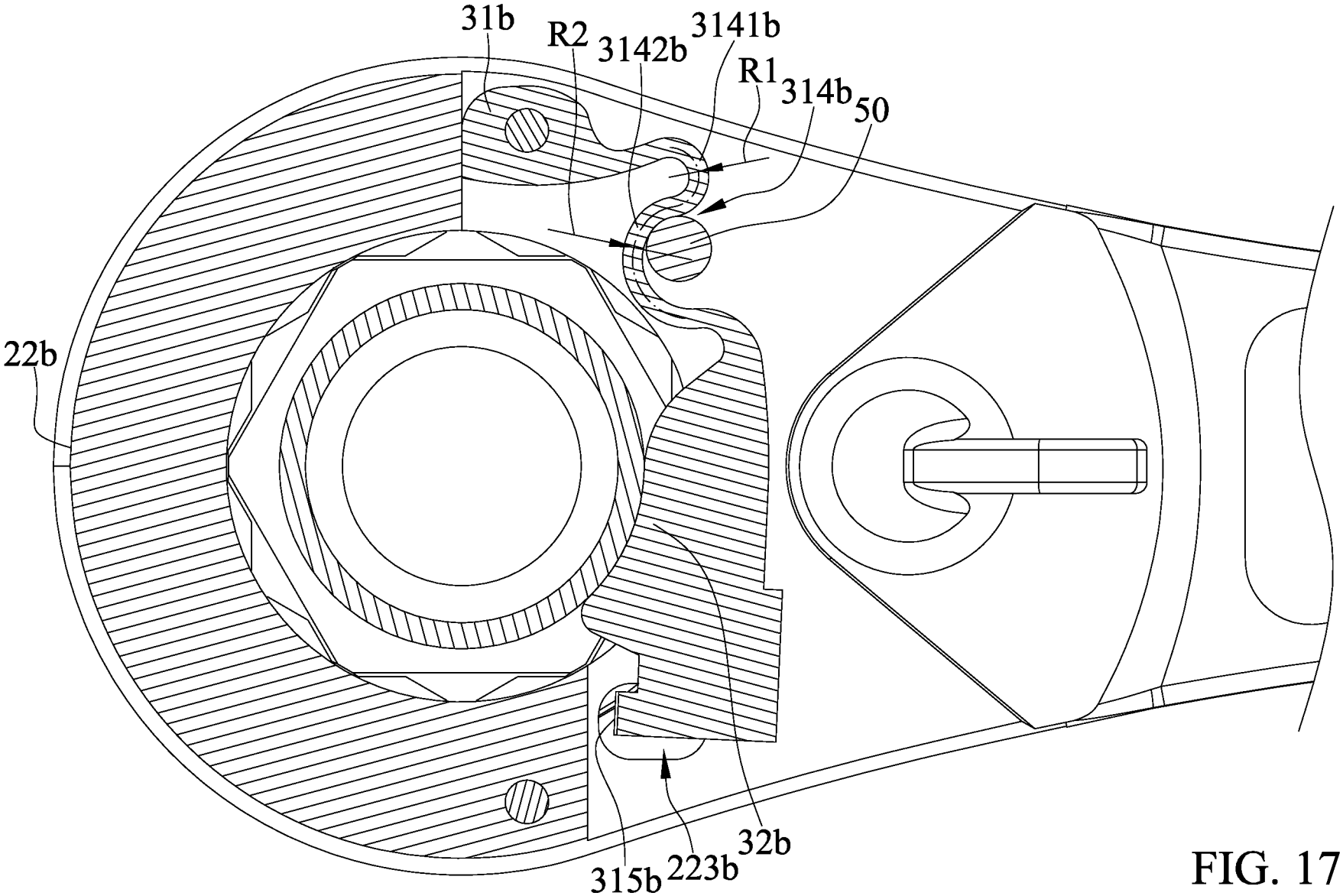
FIG. 17 is another cross-sectional view showing the clench wrench of FIG. 14 clenching the socket.
Figure 18:
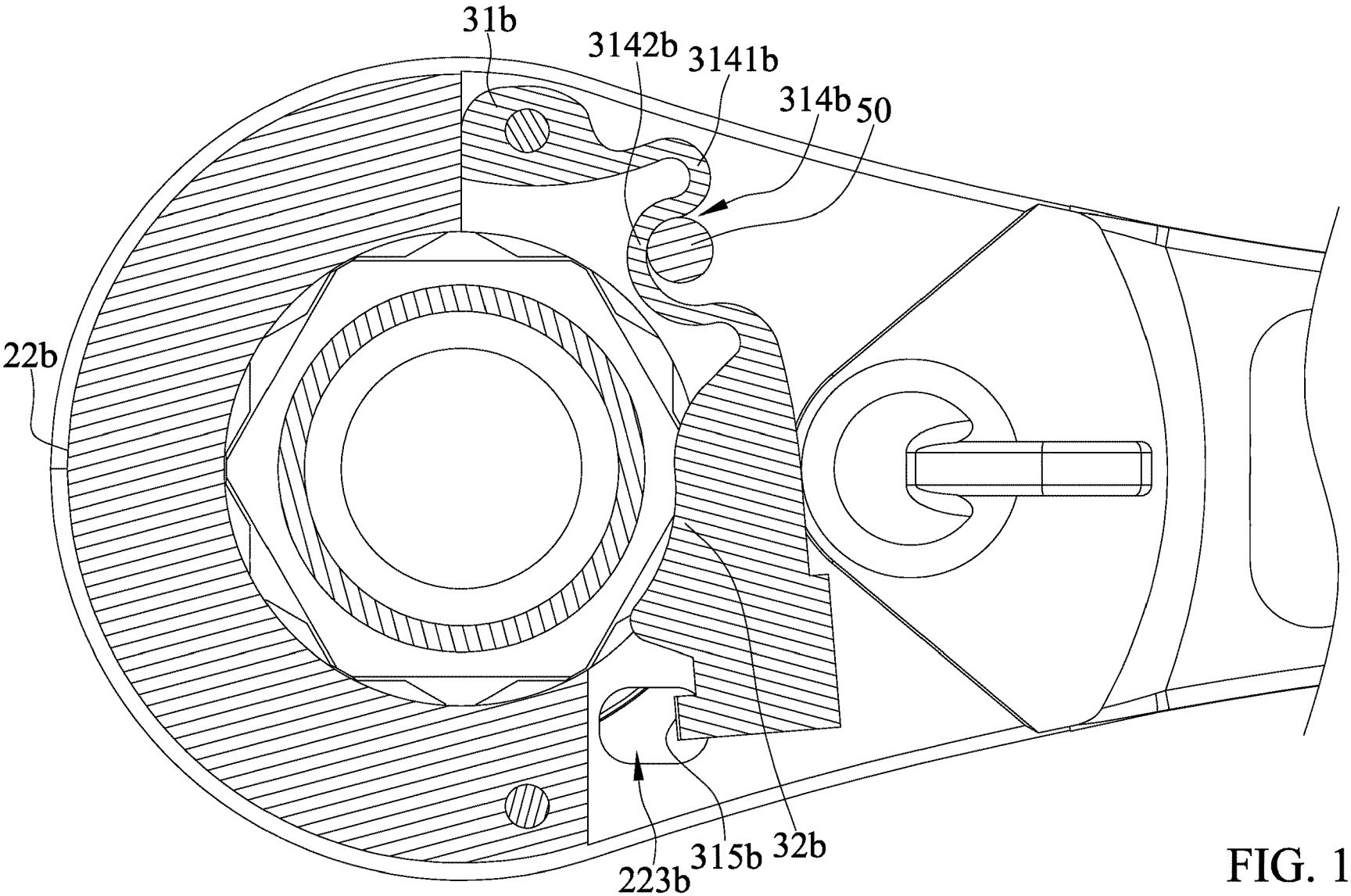
FIG. 18 is a cross-sectional view showing the clench wrench of FIG. 14 not clenching the socket.
Figure 19:
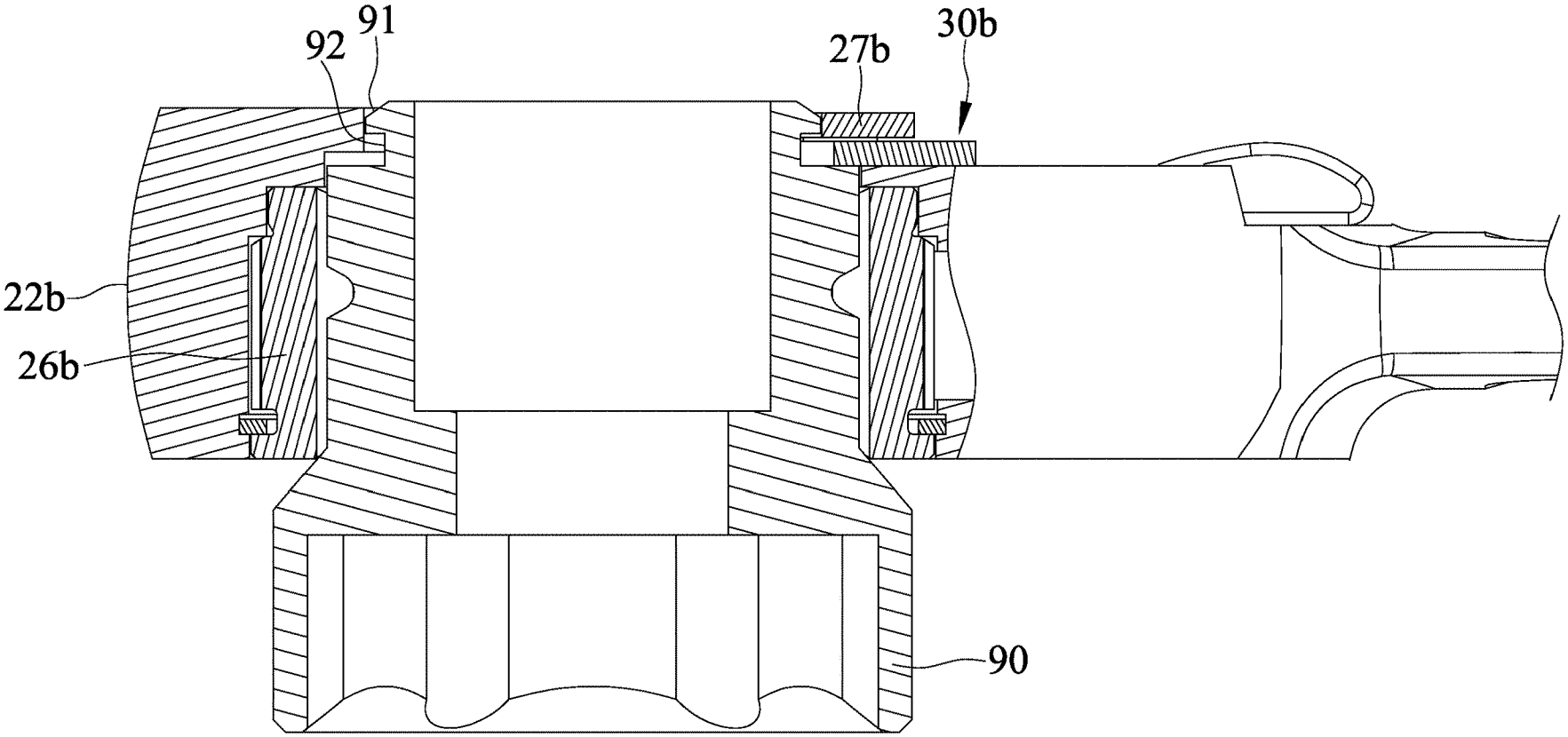
FIG. 19 is another cross-sectional view showing the clench wrench of FIG. 14 not clenching the socket.

A clenching device 30 is mounted on the engaging head and configured to clench the object. The clenching device 30 includes a clenching member 31 connected with the engaging head. The clenching member 31 is disposed on one of the front and back sides 221 and 222. The clenching member 31 has one first end fixed to the engaging head and another end being a free end. The fixed end of the clenching member 31 and one of the front and back sides 221 and 222 of the engaging head respectively includes a hole 313 and a first engaging hole 24, and a first fastener 28 inserts into the hole 313 and the first engaging hole 24 and fastens the clenching member 31 on the engaging head. The clenching member 31 is a thin plate that has a substantially smaller thickness than the thickness of the engaging head. Therefore, the clenching device 30 is configured to avoid making the clench wrench 10 too thick or not compact. The clenching member 31 is resilient. Further, the clenching member 31 includes a middle portion 314 between the fixed end and the free end. The middle portion 314 and fixed and free ends, in a lateral direction, each have a cross-sectional area, and the cross-sectional area of the middle portion 314 is smaller than the cross-sectional areas of the respective fixed and free ends. Therefore, the middle portion 314 is thinner than the widths of the fixed end and the free end, as shown in FIG. 3. The clenching member 31 is formed by bending a metal plate and has an integral structure. The clenching member 31 is a metallic member. The clenching member 31 has a clenching portion and is bendable such that the clenching portion is operably movable in a first mode located at a first position capable of clenching the object received by the engaging space 23, and a second mode located at a second position and disposed away from the engaging space 23 and capable of letting the object engaged with the engaging head to disengage therefrom. The clenching portion is located at the first position when the clenching member 31 is not operated. The clenching portion is located at the free end of the clenching member 31. The clenching portion has an outer edge forming a sloped guiding edge 3111, and the object inserting into the engaging space 23 movably abuts against the sloped guiding edge 3111. The sloped guiding edge 3111 has a lower end and an upper end and extends from the lower end to the upper end in a slanting direction to facilitate the insertion of the object into the engaging space 23. The insertion of the object into the engaging space 23 is, therefore, not impeded by the clenching member 31. The clenching member 31 has a main body 311 and includes a lever 312 protruding upwardly from the main body 311. The lever 312 is adapted to be used as a handle to facilitate the operation of the clenching member 31.

The engaging head includes a wall 27 disposed above and shielding the clenching member 31. Thus, the clenching member 31 is disposed between the wall 27 and the engaging head. The wall 27 includes a first engaging aperture 271, and the first fastener 28 inserts into the first engaging aperture 271 and the first engaging hole 24, thereby fastening the wall 27 on the engaging head. One of the front and back sides 221 and 222 of the engaging head and the wall 27 respectively include a second engaging hole 25 and a second engaging aperture 272, and a second fastener 29 inserts in the second engaging hole 25 and second engaging aperture 272 and fastens the wall 27 on the engaging head.

A switch device 40 interacts with the ratchet wheel 26 and is configured to releasably stop the ratchet wheel 26 from rotation. The switch device 40 includes an input control exposed from the engaging head. Therefore, a user of the clench wrench 10 can easily operate the switch device 40 through the input control. The input control has a thickness and the clenching member 31 has a thickness not greater than that of the input control. Therefore, the clenching device 30 is configured to avoid making the clench wrench 10 too thick or not compact In the drawings, the object is a socket 90, but is not limited thereto. The socket 90 is engaged with the clench wrench 10 and is prevented from disengaging therefrom by the clenching portion when the clench wrench 10 clenches the socket 90. Specifically, the socket 90 includes a joining end configured to be insertable into the engaging space 23, at least one recess 91, and a groove 92 formed on the joining end and configured to be adapted to receive and catch the clenching portion and the sloped guiding edge 3111. The clench wrench 10 clenches the socket 90 when the clenching portion engages in the groove 92. Consequently, the socket 90 is restrained by clenching portion of the clenching member 31 and prevented moving out of the space 23.

FIGS. 7 through 13 show a clench wrench 10*a* in accordance with a second embodiment of the present invention capable of preventing an object to be clenched disengaging from the clench wrench 10*a*, and the same numbers are used to correlate similar components of the first embodiment, but bearing a letter a.

The clench wrench 10*a* includes a structure 20*a*. The structure 20*a* includes a first body 21*a* and a second body 22*a* extending from an end of the first body 21*a*. The first body 21*a* defines a handle for a user to grasp when operating the clench wrench 10*a*. The second body 22*a* defines an engaging head for engaging with the object to be clenched. The second body 22*a* has a front side 221*a* and a back side 222*a* opposite to the front side 221*a* along the axis L. The structure 20*a* defines an engaging space 23*a* extending from the front side 221*a* to the back side 222*a* of the second body 22*a* along the axis L. The engaging space 23*a* of the structure 20*a* is configured to engage with the object and to drive the object to rotate about the axis L. The object is a socket 90, but is not limited thereto. The engaging space 23*a* is defined by an inner periphery of a ratchet wheel 26*a*. The ratchet wheel 26*a* is rotatably engaged with the engaging head and has a center of rotation about the axis L. The axis L extends in the thickness direction of the engaging head. The inner periphery of the ratchet wheel 26*a* is polygonal and its peripheral sides form ridges. The ridges can facilitate turning of the object by the clench wrench 10*a*.

A clenching device 30*a* is mounted on the structure 20*a*. In this embodiment, the clenching device 30*a* is disposed on the back side 222*a* of the second body 22*a*. The clenching device 30*a* includes a clenching member 31*a*. The clenching member 31*a* has a main body 311*a*. The main body 311*a* has one first end fixed to the engaging head and another end being a free end. Further, the fixed end of the clenching member 31*a* is prevented from moving relative to the engaging head by including a lateral side abutting a wall of the engaging head, which protrudes from the back side 222*a*. The fixed end of the clenching member 31*a* and the back side 222*a* of the engaging head respectively include a hole 313*a* and an engaging hole 24*a*, and the fastener 28 inserts into the hole 313*a* and the engaging hole 24*a* to fasten the clenching member 31*a* to the engaging head.

The clenching member 31*a* includes a lever 312*a* protruding therefrom and is adapted to be used as a handle to facilitate the operation of the clenching member 31*a*. The lever 312*a* protrudes from the main body 311*a*. The main body 311*a* has a planar surface, and the lever 312*a* protrudes upwardly from the planar surface. The lever 312*a* is disposed adjacent to the free end of the clenching member 31*a*.

The clenching member 31*a* is resilient. The clenching member 31*a* is formed by bending a metal plate and has an integral structure. The clenching member 31*a* has a clenching portion for clenching the object. In the embodiment, the clenching portion has a front side, which forms a part of a front side of the clenching member 31*a*, abuts against the object to clench the object. The clenching portion is located at the free end of the clenching member 31*a*.

The free end of the clenching member 31*a* is bendable such that the clenching portion is operably movable in a first mode located at a first position and capable of clenching the object received by the engaging space 23*a*, and a second mode located at a second position and away from the engaging space 23*a* and capable of letting the object engaged with the engaging head to disengage therefrom. The clenching portion is at the first position when the clenching member 31 is not operated. The clenching portion has an outer edge forming a sloped guiding edge 3111*a*. The sloped guiding edge 3111*a* has a lower end and an upper end and extends from the lower end to the upper end in a slanting direction that facilitates the insertion of the object into the engaging space 23*a*. The slopped guiding edge 3111*a* is neither parallel nor perpendicular to the axis L. A limiting protrusion 315*a* protrudes from a side of the clenching portion. The limiting protrusion 315*a* moves in the limiting groove 223*a* in response to the operation of the clenching member 31*a*. When the clenching portion is located at the second position, the limiting protrusion 315*a* is stopped moving out of the limiting groove 223*a* by the limiting portion 224*a*.

The clenching member 31 has a middle portion 314*a*. The middle portion 314*a* is between the fixed end and the free end of the clenching member 31*a*. The middle portion 314*a* and the fixed and free ends, in a lateral direction, each has a cross-sectional area, and the cross-sectional area of the middle portion 314*a* is smaller than the cross-sectional areas of the respective fixed and free ends. The middle portion 314*a* lies in a reference plane P that is perpendicular to the axis L. The middle portion 314*a* includes a curved portion 3141*a* and a curved portion 3142*a*. The center of curvature of the curved portion 3141*a* and the center of curvature of the curved portion 3142*a* are respectively located on two opposite sides of the clenching member 31*a*. Thus, the curved portions 3141*a* and 3142*a* have different curve orientations. The curved portion 3142*a* is located between the curved portion 3141*a* and the clenching portion. An average radius of curvature of the curved portion 3141*a* is a radius R1. An average radius of curvature of the curved portion 3142*a* is a radius R2. The radius R2 is larger than the radius R1. In this embodiment, the radius R2 is larger than 1.5 times the radius R1 and is smaller than 2 times the radius R1. The shape of the middle portion 314*a* is bendable and facilitates a user to bend the clenching member 31*a*.

The structure 20*a* includes a wall 27*a* disposed on the clenching device 30*a* and secured to the engaging head. Thus, the clenching member 31*a* is disposed between the wall 27*a* and the engaging head. The wall 27*a* is fixed to the back side 222*a* of the structure 20*a* by a fastener 28*a* and a fastener 29*a*. Each of the fastener 28*a* and the fastener 29*a* extends in a direction parallel to the axis L. The back side 222*a* of the engaging head and the wall 27*a* respectively include an engaging hole 24*a* and an engaging aperture, and the fastener 28*a* inserts in the engaging hole 24*a* and engaging aperture to fasten the wall 27 on the engaging head. Further, the back side 222*a* of the engaging head and the wall 27*a* respectively include an engaging hole 25*a* and an engaging aperture, and the fastener 29 inserts in the second engaging hole 25 and engaging aperture to fasten the wall 27 on the engaging head. The engaging head includes the wall 27*a* disposed above and shielding a clenching member 31*a* of a clenching device 30 of the second embodiment. The structure 20*a* defines a limiting groove 223*a* in the engaging head. A side of the limiting groove 223*a* includes a limiting portion 224*a*. The clenching member 31*a* includes a limiting protrusion protruding therefrom and movably engaged in the limiting protrusion 315*a* in response to the operation of the clenching member 31*a*.

FIGS. 14 through 19 show a clench wrench 10*b* in accordance with a third embodiment of the present invention capable of preventing an object to be clenched disengaging from the clench wrench 10*b*, and the same numbers are used to correlate similar components of the first embodiment, but bearing a letter b.

The clench wrench 10*b* includes a structure 20*b*. The structure 20*b* includes a first body 21*b* and a second body 22*b* extending from to an end of the first body 21*b*. The first body 21*b* defines a handle for a user to grasp when operating the clench wrench 10*b*. The second body 22*b* defines an engaging head for engaging with the object to be clenched. The second body 22*b* has a front side 221*b* and a back side 222*b* opposite to the front side 221*b* along the axis L. The structure 20*b* defines an engaging space 23*b* extending from the front side 221*b* to the back side 222*b* of the second body 22*b* along the axis L. The engaging space 23*b* of the structure 20*b* is configured to engage with the object and to drive the object to rotate about the axis L. The object is a socket 90, but is not limited thereto. The engaging space 23*b* is defined by an inner periphery of a ratchet wheel 26*b*. The ratchet wheel 26*b* is rotatably engaged with the engaging head and has a center of rotation about the axis L. The axis L extends in the thickness direction of the engaging head. The inner periphery of the ratchet wheel 26*b* is polygonal and its peripheral sides from ridges. The ridges can facilitate turning of the object by the clench wrench 10*b*.

A clenching device 30*b* is mounted on the structure 20*b*. The clenching device 30*b* is disposed on the back side 222*b* of the second body 22*a*. The clenching device 30*a* includes a clenching member 31*b*. The clenching member 31*b* is a thin plate that has a substantially smaller thickness than a thickness of the engaging head. The clenching member 31*b* has one end fixed to the engaging head and another end being a free end. The fixed end of the clenching member 31*b* and the back side 222*b* of the engaging head respectively includes a hole, and a fastener 28*b* inserts into the holes to fasten the clenching member 31*a* to the engaging head. Further, the fixed end of the clenching member 31*b* is prevented from moving relative to the engaging head by including a lateral side abutting a wall of the engaging head, which protrudes from the back side 222*b*.

The clenching member 31*a* has a main body and includes a lever 312*b*. The lever 312*b* is adapted to be used as a handle to facilitate the operation of the clenching member 31*b*. The lever 312*b* protrudes from the main body and is not covered by the wall 27*b*. The main body has a planar surface, and the lever 312*b* protrudes upwardly from the planar surface. The lever 312*b* is located adjacent to the free end of the clenching member 31*b*. The lever 312*a* facilitates the operation of the clenching member 31.

The clenching member 31*b* has a clenching portion 32*b* for clenching the object. In the embodiment, the clenching portion has a front side, which forms a part of a front side of the clenching member 31*b*, abuts against the object to clench the object.

The clenching member 31*b* is resilient. The clenching member 31*b* is formed by bending a metal plate and has an integral structure. The free end of the clenching member 31*b* is bendable such that the clenching portion 32*b* is operably movable in a first mode located at a first position and capable of clenching the object received by the engaging space 23*b*, and a second mode located at a second position and disposed away from the engaging space 23*b* and capable of letting the object engaged with the engaging head to disengage therefrom. The clenching portion 32*b* is at the first position when the clenching member 31*b* is not operated, and the clenching member 31*b* is resilient and bendable such that the clenching portion 32*b* can move automatically from the second position to the first position when there is no force causing the clenching member 31*b* to move from the first position to the second position. The clenching portion 32*b* is located at the free end of the clenching member 31*b*.

The clenching member 31*b* has a middle portion 314*b* located between the fixed end and the free end. The middle portion 314*b* and the fixed and free ends, in a lateral direction, each has a cross-sectional area, and the cross-sectional area of the middle portion 314*b* is smaller than the cross-sectional areas of the respective fixed and free ends. The middle portion 314*b* lies in a reference plane P that is perpendicular to the axis L. The middle portion 314*b* includes a curved portion 3141*b* and a curved portion 3142*b*. The center of curvature of the curved portion 3141*b* and the center of curvature of the curved portion 3142*b* are respectively located on two opposite sides of the clenching member 31*b*. Thus, the curved portions 3141*b* and 3142*b* have different curve orientations. The curved portion 3142*b* is located between the curved portion 3141*b* and the clenching portion 32*b*. An average radius of curvature of the curved portion 3141*b* is a radius R1. An average radius of curvature of the curved portion 3142*b* is a radius R2. The radius R2 is different from the radius R1. The radius R2 is larger than the radius R1. In this embodiment, the radius R2 is larger than 1.5 times the radius R1 and is smaller than 2 times the radius R1. The shape of the middle portion 314*b* is bendable and facilitates a user to bend the clenching member 31*b*.

The clenching member 31*b* includes a limiting protrusion 315*b* protruding therefrom and movably disposed in the limiting groove 223*b*. The limiting protrusion 315*b* moves in the limiting groove 223*b* in response to the operation of the clenching member 31*b*.

A block 50*b*, which is configured to enable the clenching portion 32*b* to clench the object more firmly, is disposed on the engaging head and abuts against the clenching member 31*b* to counteract the force that causes the clenching portion 32*b* to move from the first position to the second position. The block 50*b* is located on the same side of the clenching member 31*b* as the center of curvature of the curved portion 3142*b*. The block 50*b* and the axis L are located on opposite sides of the block 50*b*. The block 50*b* is disposed adjacent to the curved portion 3141*b*. The block 50*b* has a radius greater than the radius R1. The block 50*b* abuts against the clenching portion 32*b* when the clenching portion 32*b* is in first and second modes.

The structure 20*b* includes a wall 27*b* disposed on the clenching device 30*b* and secured to the engaging head. The wall 27*b* is fixed to the back side 222*b* of the structure 20*b* by a fastener 28*b* and a fastener 29*b*. Each of the fastener 28*b* and the fastener 29*b* extends in a direction parallel to the axis L. The back side 222*b* of the engaging head and the wall 27*b* respectively include a first engaging hole and first a first engaging aperture, and the fastener 28*b* inserts in the first engaging hole and the engaging aperture to fasten the wall 27*b* on the engaging head. Further, the back side 222*b* of the engaging head and the wall 27*b* respectively include a second engaging hole and a second engaging aperture, and the fastener 29*b* inserts in the second engaging hole and the second engaging aperture to fasten the wall 27*b* on the engaging head. The engaging head includes the wall 27*b* disposed above and shielding a clenching member 31*b* of a clenching device 30*b*.

The structure 20*b* defines a limiting groove 223*b* in the engaging head. A side of the limiting groove 223*b* includes a limiting portion. The clenching member 31*b* includes a limiting protrusion protruding therefrom and movably engaged in the limiting protrusion in response to the operation of the clenching member 31*b*.

In view of the foregoing, when the clenching portions 32*b* are located at the respective first positions they can clench and prevent disengagement of the socket 90 from the clench wrenches 10, 10*a*, and 10*b*, and when the clenching portions are located at the respective second positions thereof the sockets 90 can disengage from the clench wrenches 10, 10*a*, and 10*b*. Further, the clenching members 31, 31*a*, and 31*b* are resilient and bendable such that the clenching portions 32*b* can move automatically from the second position to the first position when there is no force causing the clenching members 31, 31*a*, and 31*b* to move from the first position to the second position. Further, the shape of the middle portions 314, 314*a*, and 314*b* not only facilitates the resiliency of the clenching members 31, 31*a*, and 31*b* but also prevents the object disengaging from the clenching portions 32*b* easily. In addition, since the clenching member 31*b* has one end fixed to the engaging head and the block 50*b* is disposed on the same side of the center of curvature of the curved portion 3142*b* and abuts against the back side of the clenching member 31*b*, the clenching portion 32*b* can clench the socket 90 more firmly than conventional clench wrenches.

The foregoing is merely illustrative of the principles of this invention and various modifications can be made by those skilled in the art without departing from the scope and spirit of the invention.

What is claimed is:

1. A clench wrench comprising:

a structure including a first body defining a handle for a user to grasp and a second body defining an engaging head for engaging with an object to be clenched respectively, wherein the engaging head defines an engaging space for receiving the object engaged with and to be driven by the clench wrench, wherein the engaging head has two opposite sides with one side defining a front side and the other side defining a back side respectively and includes the engaging space extending through the front and back sides and defining an opening in each of the front and back sides;

a clenching device configured for clenching the object mounted on the engaging head, wherein the clenching device includes a resilient clenching member having a fixed end fixed to the engaging head and a free end, wherein the clenching member has a clenching portion at the free end, wherein the free end of the clenching member is bendable such that the clenching portion is operably movable in a first mode located at a first position and capable of clenching the object received by the engaging space, and a second mode disposed away from the engaging space and located at a second position and capable of letting the object engaged in the engaging space of the engaging head disengage therefrom; and a block disposed on the engaging head and abutting against the clenching member and counteracting a force that causes the clenching portion to move from the first position to the second position, wherein the clenching member has a middle portion, which is bendable, located between the fixed end and the free end, and wherein the block abuts against the middle portion, wherein the middle portion and the fixed and free ends, in a lateral direction, each has a cross-sectional area, and the cross-sectional area of the middle portion is smaller than the cross-sectional areas of the respective fixed and free ends.

2. The clench wrench as claimed in claim 1, wherein the block abuts against the clenching portion when the clenching portion is in first and second modes.

3. The clench wrench as claimed in claim 1, wherein the structure includes a wall disposed on the clenching device and secured to the engaging head, and wherein the clenching member is disposed between the wall and the engaging head.

4. The clench wrench as claimed in claim 1, wherein the structure defines a limiting groove in the engaging head and the clenching member includes a limiting protrusion protruding therefrom and movably engaged in the limiting protrusion in response to the operation of the clenching member.

5. The clench wrench as claimed in claim 1, wherein the clenching member is a metallic member.

6. The clench wrench as claimed in claim 1, wherein the engaging space is defined by an inner periphery of a ratchet wheel, wherein the ratchet wheel is rotatably engaged with the engaging head and has a center of rotation about an axis.

7. The clench wrench as claimed in claim 1, wherein the clenching member is a thin plate that has a substantially smaller thickness than a thickness of the engaging head.

8. The clench wrench as claimed in claim 1, wherein the clenching member has a main body and includes a lever, which is adapted to be used as a handle to facilitates the operation of the clenching member, protruding upwardly from the main body.

9. A clench wrench comprising:

a structure including a first body defining a handle for a user to grasp and a second body defining an engaging head for engaging with an object to be clenched respectively, wherein the engaging head defines an engaging space for receiving the object engaged with and to be driven by the clench wrench, wherein the engaging head has two opposite sides with one side defining a front side and the other side defining a back side respectively and includes the engaging space extending through the front and back sides and defining an opening in each of the front and back sides;

a clenching device configured for clenching the object mounted on the engaging head, wherein the clenching device includes a resilient clenching member having a fixed end fixed to the engaging head and a free end, wherein the clenching member has a clenching portion at the free end, wherein the free end of the clenching member is bendable such that the clenching portion is operably movable in a first mode located at a first position and capable of clenching the object received by the engaging space, and a second mode disposed away from the engaging space and located at a second position and capable of letting the object engaged in the engaging space of the engaging head disengage therefrom; and a block disposed on the engaging head and abutting against the clenching member and counteracting a force that causes the clenching portion to move from the first position to the second position, wherein the clenching member has a middle portion, which is bendable, located between the fixed end and the free end, and wherein the block abuts against the middle portion, wherein the middle portion includes a first curved portion and a second curved portion, wherein the center of curvature of the first curved portion and the center of curvature of the second curved portion are respectively located on two opposite sides of the clenching member, and wherein the block is located on the same side of the clenching member as the center of curvature of the second curved portion.

10. The clench wrench as claimed in claim 9, wherein the second curved portion is located between the first curved portion and the clenching portion, and wherein an average radius of curvature of the first curved portion is a first radius and an average radius of curvature of the second curved portion is a second radius, which is larger than the first radius.

11. The clench wrench as claimed in claim 10, wherein the second radius is larger than 1.5 times the first radius and is smaller than 2 times the first radius.

* * * * *